US010100686B2

(12) United States Patent
Weber

(10) Patent No.: US 10,100,686 B2
(45) Date of Patent: Oct. 16, 2018

(54) HYDRAULIC CAMSHAFT ADJUSTER, USE, AND METHOD FOR ASSEMBLING AN AT LEAST TWO-PART ROTOR OF A HYDRAULIC CAMSHAFT ADJUSTER

(71) Applicant: SCHAEFFLER TECHNOLOGIES AG & CO. KG, Herzogenaurach (DE)

(72) Inventor: Juergen Weber, Erlangen (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 9 days.

(21) Appl. No.: 15/122,452

(22) PCT Filed: Feb. 17, 2015

(86) PCT No.: PCT/DE2015/200081

§ 371 (c)(1),
(2) Date: Aug. 30, 2016

(87) PCT Pub. No.: WO2015/139696

PCT Pub. Date: Sep. 24, 2015

(65) Prior Publication Data

US 2017/0074127 A1 Mar. 16, 2017

(30) Foreign Application Priority Data

Mar. 20, 2014 (DE) ..... 10 2014 205 237
May 15, 2014 (DE) ..... 10 2014 209 179

(51) Int. Cl.
*F01L 1/34* (2006.01)
*F01L 1/344* (2006.01)
(Continued)

(52) U.S. Cl.
CPC ..... *F01L 1/3442* (2013.01); *B22F 3/1017* (2013.01); *B22F 3/16* (2013.01);
(Continued)

(58) Field of Classification Search
CPC . F01L 1/3442; F01L 1/047; F01L 1/46; F01L 2001/34479; F01L 2101/00;
(Continued)

(56) References Cited

U.S. PATENT DOCUMENTS 5,630,953 A 5/1997 Klink
7,849,825 B2 12/2010 Scheidig et al.
(Continued)

FOREIGN PATENT DOCUMENTS

CN 102124188 A 7/2011
CN 102667076 A 9/2012
(Continued)

OTHER PUBLICATIONS

International Search Report for International Application No. PCT/DE2015/200081 dated May 19, 2015.

*Primary Examiner* — Zelalem Eshete
(74) *Attorney, Agent, or Firm* — Brooks Kushman P.C.

(57) ABSTRACT

A hydraulic camshaft adjuster, including a two-part rotor connected at least to a camshaft in a rotationally fixed manner. The at least two-part rotor can be rotated about an axis and comprises a first rotor element and a second rotor element. The first rotor element and the second rotor element are axially preloaded against the camshaft in a frictionally locked manner exclusively by means of a threaded connection.

9 Claims, 2 Drawing Sheets

(51) Int. Cl.

| | |
|---|---|
| ***F01L 1/46*** | (2006.01) |
| ***B22F 3/10*** | (2006.01) |
| ***B22F 3/16*** | (2006.01) |
| ***B22F 5/00*** | (2006.01) |
| ***F01L 1/047*** | (2006.01) |

(52) U.S. Cl.
CPC ..... *B22F 5/00* (2013.01); *F01L 1/047* (2013.01); *F01L 1/46* (2013.01); *F01L 2001/34479* (2013.01); *F01L 2101/00* (2013.01); *F01L 2103/00* (2013.01); *F01L 2103/01* (2013.01)

(58) Field of Classification Search
CPC ..... F01L 2103/00; F01L 2103/01; B22F 3/16; B22F 5/00
See application file for complete search history.

(56) References Cited

U.S. PATENT DOCUMENTS

| | | | | |
|---|---|---|---|---|
| 8,550,046 | B2 | 10/2013 | Terfloth et al. | |
| 2005/0056249 | A1 | 3/2005 | Heinze et al. | |
| 2005/0103294 | A1* | 5/2005 | Heinze | F01L 1/022 123/90.17 |
| 2012/0132160 | A1* | 5/2012 | Malen | B22F 5/008 123/90.15 |
| 2013/0269639 | A1 | 10/2013 | Weber | |

FOREIGN PATENT DOCUMENTS

| | | | |
|---|---|---|---|
| DE | 4316012 | A1 | 11/1994 |
| DE | 102008028640 | A1 | 12/2009 |
| DE | 102009031934 | A1 | 1/2011 |
| DE | 102009053600 | A1 | 5/2011 |
| DE | 2010063700 | A1 | 6/2012 |
| DE | 102011117856 | A1 | 5/2013 |
| DE | 102012102022 | A1 | 9/2013 |
| EP | 1731722 | B1 | 12/2008 |
| EP | 2300693 | B1 | 8/2012 |
| GB | 2278563 | A | 7/1994 |
| WO | 2007025630 | A1 | 3/2007 |
| WO | 2010128976 | A1 | 11/2010 |

* cited by examiner

HYDRAULIC CAMSHAFT ADJUSTER, USE, AND METHOD FOR ASSEMBLING AN AT LEAST TWO-PART ROTOR OF A HYDRAULIC CAMSHAFT ADJUSTER

CROSS-REFERENCE TO RELATED APPLICATIONS

This application is the U.S. National Phase of PCT Appln. No. PCT/DE2015/200081 filed Feb. 17, 2015, which claims priority to DE 10 2014 205 237.8 filed Mar. 20, 2014 and DE 10 2014 209 179.9 filed May 15, 2014, the entire disclosures of which are incorporated by reference herein.

TECHNICAL FIELD

The present disclosure relates to a hydraulic camshaft adjuster having an at least two-piece rotor non-rotatably connected to a camshaft. The at least two-piece rotor can rotate about an axis, and is composed of a first rotor element and a second rotor element.

The present disclosure also relates to a use of an at least two-piece rotor in a hydraulic camshaft adjuster.

The present disclosure furthermore relates to a method for installing an at least two-piece rotor of a hydraulic camshaft adjuster.

BACKGROUND

It is generally known that camshaft adjusters enable optimal valve control times over a broad load and rotational rate range for a motor. In this manner, significant reductions in emissions and fuel consumption have been achieved. Furthermore, by optimizing the torque and the performance, the driving enjoyment is increased significantly. A distinction is made in the prior art between electric camshaft adjusters and the hydraulic camshaft adjusters specified in the introduction.

Rotors are known from the field of hydraulic camshaft adjusters, which are composed of a first rotor element and a second rotor element. This is disclosed, for example, in the German patent application DE 10 2009 053 600 A1. Two rotor elements are connected with pins or sintered therein. A connection of this type, in which two rotor elements 4, 6 are connected to one another with pins 5 and additionally by means of an oil distribution and centering sleeve 7, is depicted by way of example in FIGS. 1 to 3.

Another embodiment for joining two rotor elements of a rotor is described in the German patent application DE 10 2009 031 934 A1. Two rotor elements made of plastic are mounted on a steel support therein. Two rotor elements that are joined, and subsequently glued to one another as well, is disclosed in the international patent application WO 2010/128976 A1. Two rotor elements are designed in the German patent application DE 10 2008 028 640 A1 such that they can be joined due to their respective "distinct" geometries. Two rotor elements that seal oil channels through sinter facets, and are thus connected to one another, is disclosed in the German patent application DE 10 2011 117 856 A1. The European patent application EP 2 300 693 B1 furthermore describes two identical rotor elements, joined by means of a form fit and press fit to form the oil channels. The rotor designed in the form of a composite system, wherein the rotor core plus the cover form the oil channels, is disclosed in the European patent application EP 1 731 722 B1. The German patent application DE 10 2010 063 700 A1 describes a similar design. In this case, the oil channels are formed by grooves on the rotor in the shape of a pan. In order to enable an unobstructed pressurizing medium flow of the oil in the camshaft adjuster, an annular space is formed between a valve housing and the surrounding construction in the European patent application EP 1 924 759 A1.

In all of the documents specified above, there are additional tensions and deformations in the connection of the assembled rotor. These tensions and deformations result, disadvantageously, in a general compromise to the functioning of the rotor, and furthermore, the rotor becomes less robust during operation.

One objective of the present disclosure is therefore to further develop an economical hydraulic camshaft adjuster have an at least two-piece rotor, such that these tensions and deformations are reduced in the camshaft adjuster, and as a result, to reduce losses in terms of stability in the at least two-piece rotor.

This objective is achieved by a hydraulic camshaft adjuster having an at least two-piece rotor, comprising the features described herein.

Another objective of the present disclosure is to define a use of an at least two-piece rotor in a hydraulic camshaft adjuster, such that tensions and deformations in the camshaft adjuster are reduced during operation, and as a result, the at least two-piece rotor is not subjected to a loss in stability.

This objective is achieved in a use of an at least two-piece rotor in a hydraulic camshaft adjuster comprising the features described herein.

Another objective of the present disclosure is to provide an economic method for the installation of an at least two-piece rotor for a hydraulic camshaft adjuster, such that tensions and deformations in the camshaft adjuster during operation are reduced, and as a result, the at least two-piece rotor is not subjected to a loss in stability.

This objective is achieved by means of a method for installing an at least two-piece rotor for a hydraulic camshaft adjuster comprising the features described herein.

SUMMARY

The hydraulic camshaft adjuster according to the disclosure, having an at least two-piece rotor, non-rotatably connected to a camshaft, can rotate about an axis, and is composed of a first rotor element and a second rotor element.

In accordance with this disclosure, the first rotor element and the second rotor element are axially pre-tensioned in a force-fitting manner against the camshaft using only a screw assembly.

According to one embodiment, an axial pre-tensioning force of a central screw, also referred to as a central valve, of the screw assembly is therefore configured for a force-fitting pre-tensioning of the at least two-piece rotor in a respective rotor bore-hole in the first and second rotor elements, such that the axial pre-tension force is greater than a counter-load acting on the assembled at least two-piece rotor. The acting counter-load is understood to mean, thereby, the sum of the installation and/or operating loads, e.g. adjustment torque, shear force, inner oil pressure, stabilizing torque, during installation, etc. It should be noted here that the rotor bore-holes in the first and second rotor elements specified in the present application are frequently referred to as annular channels in technical terminology.

A first embodiment provides that the first and second rotor elements are centered in relation to one another and to the camshaft via the central screw by means of the axial pre-tension of the central screw.

In another embodiment of the hydraulic camshaft adjuster according to this disclosure, friction reducing surface elements, surface treatments or laser structurings having different material hardnesses are provided in an interstice between the central screw and the respective rotor bore-hole in the first and second rotor elements of the screw assembly. These formations are provided as friction increasing measures, as is also the case, for example, in an interstice of the at least two-piece rotor and a spring receiver/sensor wheel (trigger wheel), which can be used for additional reduction of the axial pre-tension force and thus for reducing the tensions and strains in the screw assembly and in the at least two-piece rotor.

Another embodiment of the present disclosure provides that the first and second rotor elements are connected to one another by means of an adhesive and/or welded bond. In particular, both rotor elements are material and substance bonded to one another in a welded bond.

In another embodiment of the present disclosure, in order to generate the force fit of the at least two-piece rotor between the central screw and the camshaft, it is further proposed that the screw assembly be configured such that a thread base radius of the central screw is increased in comparison with the prior art, by means of which a stress concentration is reduced in an advantageous manner.

It should also be noted that the first and second rotor elements are incorporated in the screw assembly as a single unit, and are attached to a motor as an assembly, without both rotor elements having to be connected to one another first. For installation purposes, the two rotor elements can then be held together by a transportation securing device during shipping.

The method according to the present disclosure for installing an at least two-piece rotor for a hydraulic camshaft adjuster is characterized by the following step according to the disclosure. A first rotor element and a second rotor element are axially tightened against a camshaft in a force-fitting manner using only a screw assembly. In an embodiment, an axial pre-tensioning force of a central screw of the screw assembly is configured for a force-fitting pre-tensioning of the at least two-piece rotor in a respective rotor bore-hole in the first and second rotor elements, such that the axial pre-tension force is greater than a counter-load acting on the assembled, at least two-piece, rotor.

As a result of the axial pre-tensioning of the central screw, the first and second rotor elements are centered in relation to one another and to the camshaft via the central screw.

In an embodiment of the method according to the present disclosure, the first and the second rotor elements are connected to one another by means of an adhesive and/or welded bond, prior to the pre-tensioning.

As a result of the force-fitting axial pre-tensioning of the first and second rotor elements against the camshaft by means of the central screw of the screw assembly, tensions and deformations of the camshaft adjuster can thus be reduced with the teachings of this disclosure during operation in an advantageous manner, such that, as a result, the at least two-piece rotor is not subjected to stability losses. The problems occurring in the prior art, described in the introduction, are thus eliminated by the present disclosure. Furthermore, a cost reduction in relation to the previously known hydraulic camshaft adjusters, having an at least two-piece rotor, is obtained by means of the present disclosure, because a connection of the first and second rotor elements with pins or suchlike is eliminated.

BRIEF DESCRIPTION OF THE DRAWINGS

Exemplary embodiments of the present disclosure, and the advantages thereof, shall be explained in greater detail below with reference to the attached Figures. The proportions in the figures do not always correspond to the actual proportions, because some shapes are simplified, and other shapes are enlarged for the sake of a better illustration, in relation other elements. Therein.

DETAILED DESCRIPTION

Identical reference symbols are used for identical elements, or elements having the same function. Furthermore, for purposes of clarity, only those reference symbols that are necessary for the description of the respective Figure are depicted in the individual Figures. The depicted embodiments only represent examples of how the hydraulic camshaft adjuster according to the present disclosure, the use according to the present disclosure, and the method for installing an at least two-piece rotor of a hydraulic camshaft adjuster could be designed, and thus do not represent a closed delimiting of the present disclosure.

Figure 1:
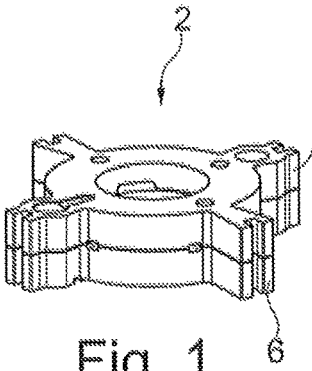
Fig. 1 Prior Art
FIGS. 1 and 2 show a perspective view of a two-piece rotor for a hydraulic camshaft adjuster, known from the prior art.
Figure 2:
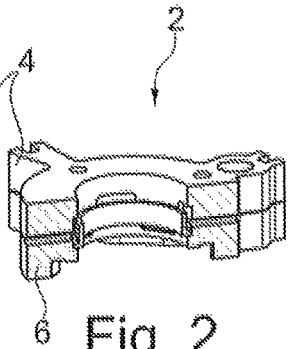
Fig. 2 Prior Art
Figure 3:
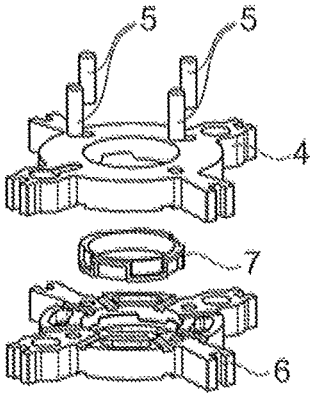
Fig. 3 Prior Art
FIG. 3 shows an exploded view of the two-piece rotor for a hydraulic camshaft adjuster according to FIGS. 1 and 2, known from the prior art.

FIGS. 1 and 2 show perspective views, and FIG. 3 shows an exploded view, of a two-piece rotor 2 of a hydraulic camshaft adjuster 1 (not shown) known from the prior art. A first and a second rotor element 4, 6 are connected to one another with pins 5, by means of an oil distribution and centering sleeve 7. This connection can then lead to tensions and deformations of the two rotor elements 4, 6 during operation. Because this problem occurring in the prior art has already been described in the introduction, there shall be no further explanation thereof at this point.

Figure 4:
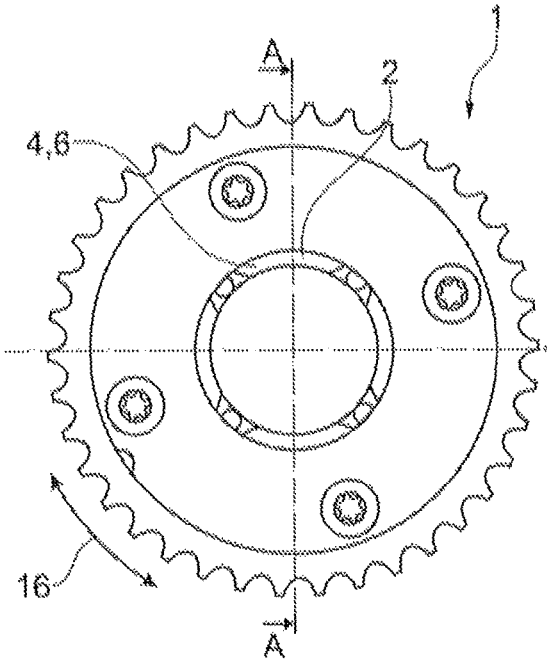
FIGS. 4 and 5 show a top view and a sectional view along the line A-A from FIG. 4 of the hydraulic camshaft adjuster according to the present disclosure, having an at least two-piece rotor.
Figure 5:
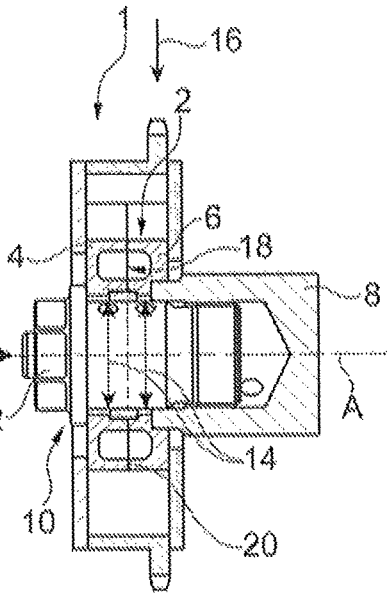

FIG. 4 shows a top view, and FIG. 5 shows a sectional view along the line A-A in FIG. 4, of the hydraulic camshaft adjuster 1 according to the present disclosure, having an at least two-piece rotor 2, non-rotatably connected to the camshaft 8, which can rotate about an axis A. The at least two-piece rotor 2 is composed here of a first rotor element 4 and a second rotor element 6. In accordance with the present disclosure, the first rotor element 4 and the second rotor element 6 are axially pre-tensioned in a force fitting manner against the camshaft 8 using only a screw assembly 10.

An axial pre-tensioning force F of a central screw 12 of the screw assembly 10 for the force-fitting pre-tensioning of the at least two-piece rotor 2 in a respective rotor bore-hole 14 in the first and second rotor elements 4, 6 is configured thereby, such that the axial pre-tensioning force F is greater than a counter-load 16 acting on the assembled at least two-piece rotor 2.

As friction increasing measures, laser structurings are provided in the embodiment shown here, of the hydraulic camshaft adjuster 1 according to one embodiment of the invention, in an interstice 18 between the central screw 12 and the respective rotor bore-hole 14 in the first and second rotor elements 4, 6 of the screw assembly 10, for example. Surface structures having different material hardnesses and/or adhesives could also be provided, however, in these interstices 18.

Figure 6:
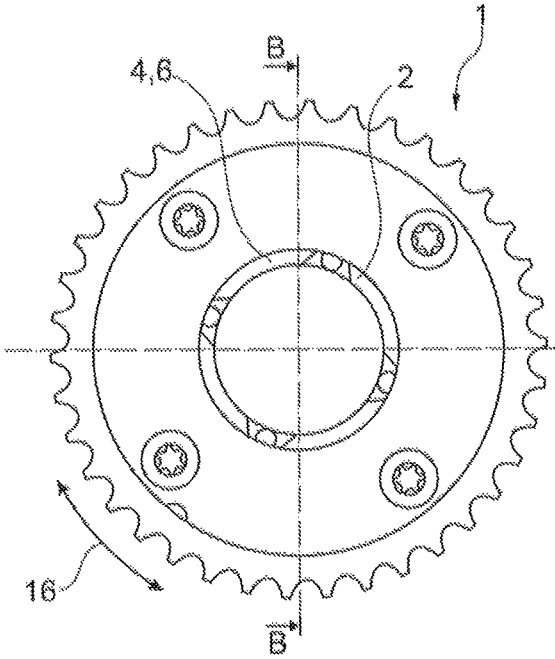
FIGS. 6 and 7 show a top view and a sectional view along the line B-B from FIG. 6, of the hydraulic camshaft adjuster according to the present disclosure.
Figure 7:
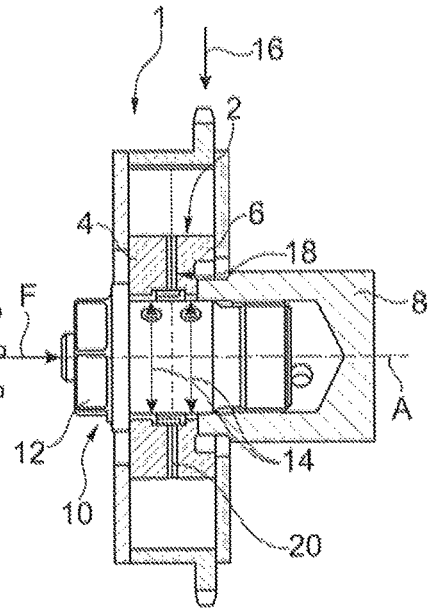
Figure 8:
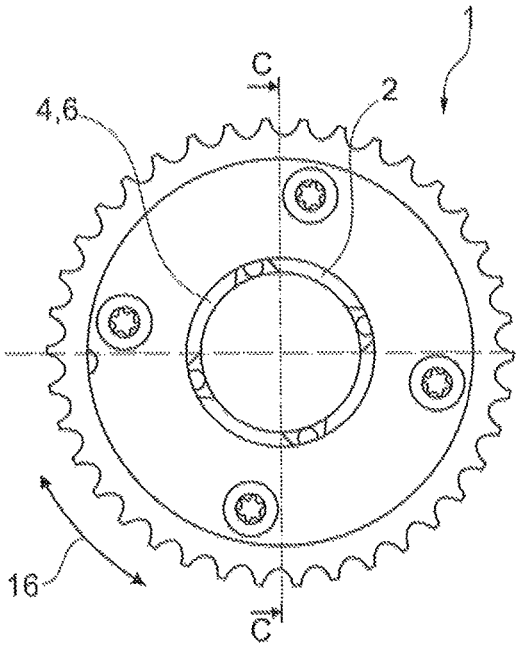
FIGS. 8 and 9 show a top view and a sectional view along the line C-C from FIG. 8, of the hydraulic camshaft adjuster according to the present disclosure.
Figure 9:
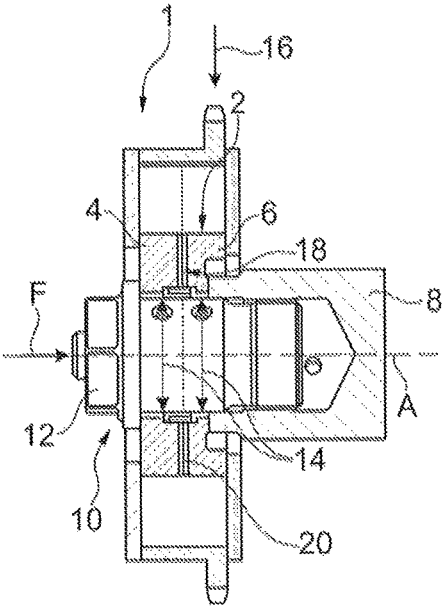

FIG. 6 shows a top view of, and FIG. 7 shows a sectional view through, an oil supply channel, along the line B-B from FIG. 6 of the hydraulic camshaft adjuster 1 according to an embodiment of this invention, according to FIGS. 4 and 5. Because the reference symbols depicted in FIGS. 6 and 7 have already been explained in reference to the preceding FIGS. 4 and 5, there shall be no repeated explanation at this point. The same applies to FIGS. 8 and 9, because FIG. 8 shows a top view, and FIG. 9 shows a sectional view through another oil supply channel along the line C-C from FIG. 8, of the hydraulic camshaft adjuster 1 according to the present disclosure, according to FIGS. 4 and 5.

REFERENCE SYMBOLS

1 hydraulic camshaft adjuster
2 rotor
4 first rotor element
5 pin
6 second rotor element
7 oil distribution and centering sleeve
8 camshaft
10 screw assembly
12 central screw
14 rotor bore-hole
16 counter-load
18 interstice
20 adhesive and/or welded bond
A axis
F pre-tensioning force
A-A line
B-B line
C-C line

The invention claimed is:

1. A hydraulic camshaft adjuster, comprising:

at least a two-piece rotor non-rotatably connected to a camshaft, which can rotate about an axis, the rotor having a first rotor element and a second rotor element, wherein the first rotor element and the second rotor element are axially pre-tensioned in a force-fitting manner against the cam shaft using only a screw assembly;

wherein the screw assembly includes a central screw extending through a bore-hole in the first and second rotor elements, the screw providing an axial pre-tensioning force along a central axis of the bore-hole, wherein the axial pre-tensioning force is greater than a counter-load acting on the two-piece rotor in a transverse direction relative to the central axis; and wherein the first rotor element and the second rotor element cooperate to define an interstice therebetween, wherein the rotor includes surface structures having different material hardnesses within the interstice to increase the friction between the first rotor element and the second rotor element.

2. The hydraulic camshaft adjuster according to claim 1, wherein the first and the second rotor elements are centered via the central screw in relation to one another and to the camshaft.

3. The hydraulic camshaft adjuster according to claim 1, wherein friction reducing surface elements, surface treatments, or laser structurings having different material hardnesses are provided in an interstice between the central screw and the respective rotor bore-holes in the first and second rotor elements of the screw assembly.

4. The hydraulic camshaft adjuster according to claim 1, wherein the first and second rotor elements are connected to one another by an adhesive and/or welded bond.

5. The hydraulic camshaft adjuster of claim 1, wherein the first rotor element and the second rotor element cooperate to define an interstice therebetween, wherein the rotor includes surface structures having an adhesive within the interstice to increase the friction between the first rotor element and the second rotor element.

6. A hydraulic camshaft adjuster for a vehicle equipped with a variable valve timing system, the hydraulic camshaft adjuster comprising:

a camshaft rotatable about an axis and having a receptacle at an end thereof;

a rotor rotatable about the axis and having a first rotor element with a first bore hole, and a second rotor element with a second bore hole and attached to the first rotor element; and a fastener extending through the first and second bore-holes and into the receptacle to mount the rotor to the camshaft;

wherein the fastener provides an axial pre-tensioning force extending along the axis that is greater than a counter-load acting on the rotor in a transverse direction relative to the axis, and wherein the first rotor element and the second rotor element cooperate to define an interstice therebetween, wherein the rotor includes surface structures having different material hardnesses within the interstice to increase the friction between the first rotor element and the second rotor element.

7. The hydraulic camshaft adjuster of claim 6, wherein the receptacle extends along the axis, and the first and second boreholes are located at a center of the first and second rotor elements, respectively.

8. The hydraulic camshaft adjuster of claim 6, wherein the fastener is a screw.

9. The hydraulic camshaft adjuster of claim 6, wherein the first rotor element and the second rotor element cooperate to define an interstice therebetween, wherein the rotor includes surface structures having an adhesive within the interstice to increase the friction between the first rotor element and the second rotor element.

* * * * *